US009055374B2

(12) United States Patent
Krishnamoorthi et al.

(10) Patent No.: US 9,055,374 B2
(45) Date of Patent: Jun. 9, 2015

(54) METHOD AND SYSTEM FOR DETERMINING AN AUDITORY PATTERN OF AN AUDIO SEGMENT

(75) Inventors: Harish Krishnamoorthi, Tempe, AZ (US); Andreas Spanias, Tempe, AZ (US); Visar Berisha, Tempe, AZ (US)

(73) Assignee: Arizona Board of Regents for and on behalf of Arizona State University, Scottsdale, AZ (US)

( * ) Notice: Subject to any disclaimer, the term of this patent is extended or adjusted under 35 U.S.C. 154(b) by 1262 days.

(21) Appl. No.: 12/822,875

(22) Filed: Jun. 24, 2010

(65) Prior Publication Data

US 2011/0150229 A1 Jun. 23, 2011

Related U.S. Application Data

(60) Provisional application No. 61/220,004, filed on Jun. 24, 2009.

(51) Int. Cl.
*H04R 29/00* (2006.01)

(52) U.S. Cl.
CPC ..... *H04R 29/00* (2013.01)

(58) Field of Classification Search
CPC ..... H04R 25/30; H04R 25/305; H04R 25/35; H04R 25/353; H04R 25/356; H04R 25/40; H04R 25/43; H04R 25/50; H04R 25/505; H04R 25/55; H04R 25/552; H04R 25/70; G10L 19/24; G10L 19/00; G10L 19/06; G10L 19/02; G10L 19/0204; G10L 19/04; G10L 19/12; G10L 21/0208; G10L 21/02
USPC ..... 381/23.1, 56, 58, 312, 320, 60; 704/223, 230, 264, 205–206, 271
See application file for complete search history.

(56) References Cited

U.S. PATENT DOCUMENTS 4,982,435 A 1/1991 Kato et al.
5,550,924 A 8/1996 Helf et al.

(Continued)

OTHER PUBLICATIONS

Berisha, V., et al., "Wideband speech recovery using psychoacoustic criteria," EURASIP Journal on Audio, Speech and Music Processing, vol. 2007, Issue 2, Apr. 2007, 18 pages.

(Continued)

*Primary Examiner* — Davetta W Goins
*Assistant Examiner* — Jasmine Pritchard
(74) *Attorney, Agent, or Firm* — Withrow & Terranova, P.L.L.C.

(57) ABSTRACT

A method and apparatus for determining an auditory pattern associated with an audio segment. An average intensity at each of a first plurality of detector locations on an auditory scale based at least in part on a first plurality of frequency components that describe a signal is determined. A plurality of tonal bands in the audio segment, wherein each tonal band comprises a particular range of detector locations of the first plurality of detector locations is determined. Corresponding strongest frequency components in the tonal bands are determined. A plurality of non-tonal bands is determined, and each non-tonal band is subdivided into multiple sub-bands. Corresponding combined frequency components that are representative of a combined sum of intensities of the first plurality of frequency components that is in a corresponding sub-band are determined. An auditory based on the corresponding strongest frequency components and the corresponding combined frequency components is determined.

22 Claims, 9 Drawing Sheets

(56) References Cited

U.S. PATENT DOCUMENTS

| | | | | |
|---|---|---|---|---|
| 5,627,938 | A | 5/1997 | Johnston | |
| 5,682,463 | A * | 10/1997 | Allen et al. | 704/230 |
| 5,742,733 | A | 4/1998 | Jarvinen | |
| 5,774,842 | A | 6/1998 | Nishio et al. | |
| 6,925,434 | B2 * | 8/2005 | Oomen et al. | 704/206 |
| 7,039,204 | B2 | 5/2006 | Baumgarte | |
| 7,089,176 | B2 * | 8/2006 | Boillot et al. | 704/200.1 |
| 7,177,803 | B2 | 2/2007 | Boillot et al. | |
| 7,337,107 | B2 | 2/2008 | Rose et al. | |
| 7,519,538 | B2 * | 4/2009 | Villemoes et al. | 704/501 |
| 7,617,100 | B1 * | 11/2009 | Luo | 704/230 |
| 7,787,956 | B2 * | 8/2010 | Grayden et al. | 607/57 |
| 7,921,007 | B2 * | 4/2011 | Van de Par et al. | 704/200.1 |
| 8,213,624 | B2 * | 7/2012 | Seefeldt | 381/56 |
| 8,239,050 | B2 * | 8/2012 | Crockett et al. | 700/94 |
| 8,260,607 | B2 * | 9/2012 | Villemoes et al. | 704/201 |
| 8,428,270 | B2 * | 4/2013 | Crockett et al. | 381/56 |
| 8,437,482 | B2 * | 5/2013 | Seefeldt et al. | 381/104 |
| 8,682,652 | B2 * | 3/2014 | Herre et al. | 704/200.1 |
| 2005/0078832 | A1 | 4/2005 | Van De Par | |
| 2005/0192646 | A1 * | 9/2005 | Grayden et al. | 607/57 |
| 2007/0112573 | A1 | 5/2007 | Gerrits et al. | |
| 2009/0067644 | A1 * | 3/2009 | Crockett et al. | 381/98 |
| 2009/0304190 | A1 * | 12/2009 | Seefeldt et al. | 381/56 |
| 2010/0250242 | A1 * | 9/2010 | Li | 704/200.1 |
| 2014/0072126 | A1 * | 3/2014 | Uhle et al. | 381/56 |

OTHER PUBLICATIONS

Spanias, A., "Speech Coding: A Tutorial Review," Proceedings of the IEEE, vol. 82 No. 10, Oct. 2004, pp. 1541-1582.

Fletcher, H., "Auditory patterns," Reviews of Modern Physics, vol. 12, No. 1, Jan. 1940, pp. 47-65.

Fastl, H., et al., "Psychoacoustics: Facts and Models," 3rd edition, Springer, 2006, pp. 150-173; 356-359.

Moore, B.C.J., et al., "A Model for the Prediction of Thresholds, Loudness, and Partial Loudness," Journal of the Audio Engineering Society, vol. 45, Issue 4, Apr. 1997, pp. 224-24.

Glasberg, B.R., et al., "A Model of Loudness Applicable to Time-Varying Sounds," Journal of the Audio Engineering Society, vol. 50, Issue 5, May 2002, pp. 331-342.

Painter, T., et al., "Perceptual segmentation and component selection for sinusoidal representations of audio," IEEE Transactions on Speech and Audio Processing, vol. 13, Issue 2, Mar. 2005, pp. 149-162.

Pereira, F., et al., "The MPEG-4 Book. IMSC Press Multimedia Series," Prentice Hall PTR, 2002, pp. 525-539.

Atti, V., et al., "Rate determination based on perceptual loudness," IEEE International Symposium on Circuits and Systems (ISCAS 2005), vol. 2, May 23-26, 2005, pp. 848-851.

Spanias, A., et al., "Audio Signal Processing and Coding," Wiley-Interscience, Feb. 2007, pp. 120-127; 390-399; 400-401.

Glasberg, B.R., et al., "Derivation of auditory filter shapes from notched-noise data," Hearing Research, vol. 47, Issues 1-2, Aug. 1990, pp. 103-138.

Krishnamoorthi, H., et al., "An auditory-domain based speech enhancement algorithm," IEEE International Conference on Acoustics, Speech and Signal Processing (ICASSP 2010), Mar. 14-19, 2010, Dallas, Texas, pp. 4786-4789.

Moore, B.C.J., "An Introduction to the Psychology of Hearing," 5th edition. Academic Press, 2003, pp. 55-59; 68-79.

Krishnamoorthi, H., et al., "A Frequency/Detector Pruning Approach for Loudness Estimation," IEEE Signal Processing Letters, vol. 16, Issue 11, Nov. 2009, pp. 997-1000.

George, E.B., et al., "Analysis-by-Synthesis/Overlap-Add Sinusoidal Modeling Applied to the Analysis and Synthesis of Musical Tones," Journal of the Audio Engineering Society, vol. 40, Issue 6, Jun. 1992, pp. 497-516.

McAulay, R., et al., "Speech Analysis/Synthesis based on a sinusoidal representation," IEEE Transactions on Acoustics, Speech and Signal Processing, vol. 34, Issue 4, Aug. 1986, pp. 744-754.

Levine, S., et al., "A Sines+Transients+Noise Audio Representation for Data Compression and Time/Pitch Scale Modifications," Proceedings of the 105th Convention of the Audio Engineering Society, Sep. 1998, 22 pages.

Vera-Candeas, P., et al., "A Sinusoidal Modeling Approach based on Perceptual Matching Pursuits for Parametric Audio Coding," 118th AES Convention, May 2005, 6 pages.

Spanias, A., et al., "A Mixed Fourier/Walsh Transform Scheme for Speech Coding at 4 KBPS," Proc. IEEE-Part I, vol. 139, No. 5, Oct. 1992, pp. 473-481.

Purnhagen, H. et al., "Sinusoidal Coding Using Loudness-Based Component Selection," Proceedings of IEEE International Conference on Acoustics, Speech and Signal Processing, May 2002, pp. 1817-1280.

Skovenborg, E. et al., "Evaluation of Different Loudness Models with Music and Speech Materials," Presented at the 117th Audio Engineering Society Convention, Oct. 28-31, 2004, 34 pages.

Painter, T. et al., "Perceptual Coding of Digital Audio," Proceedings of the IEEE, vol. 88 No. 4, Apr. 2000, pp. 451-513.

Lopez-Poveda et al., "A Human Nonlinear Cochlear Filterbank," Journal of the Acoustical Society of America, vol. 110 No. 6, Dec. 2001, pp. 3107-3118.

Dau, T. et al., "A Quantitative Model of the "effective" signal processing in the auditory System. I. Model Structure," Journal of the Acoustical Society of America, vol. 99 No. 6, Jun. 1996, pp. 3615-3622.

Krishnamoorthi, H. et al., "Low-Complexity Loudness Based Component Selection," Proc. of IEEE ICASSP, May 2002, 4 pages.

* cited by examiner

METHOD AND SYSTEM FOR DETERMINING AN AUDITORY PATTERN OF AN AUDIO SEGMENT

RELATED APPLICATIONS

This application claims the benefit of provisional patent application Ser. No. 61/220,004, filed Jun. 24, 2009, the disclosure of which is hereby incorporated herein by reference in its entirety.

FIELD OF THE DISCLOSURE

Embodiments disclosed herein relate to processing audio signals, and in particular to determining an excitation pattern of a segment of an audio signal.

BACKGROUND

Loudness represents the magnitude of the perceived intensity according to a human listener and is measured in units of sones. Experiments have revealed that critical bandwidths play an important role in loudness summation. In view of this, elaborate models that mimic the various stages of the human auditory system (outer ear, middle ear, and inner ear) have been proposed. Such models model the cochlea as a bank of auditory filters with bandwidths corresponding to critical bandwidths. One advantage of such models is that they enable the determination of intermediate auditory patterns, such as excitation patterns (e.g., the magnitude of the basilar membrane vibrations) and loudness patterns (e.g., neural activity patterns) in addition to a final loudness estimate.

These auditory patterns correspond to different aspects of hearing sensations and are also directly related to the spectrum of any audio signal. Therefore, several speech and audio processing algorithms have made use of excitation patterns and loudness patterns in order to process the audio signals according to the perceptual qualities of the human auditory system. Some examples of such applications are bandwidth extension, sinusoidal analysis-synthesis, rate determination, audio coding, and speech enhancement applications. The excitation and loudness patterns have also been used in several objective measures that predict subjective quality, volume control, and hearing aid applications. However, obtaining the excitation and loudness patterns typically requires employing elaborate auditory models that include a model for sound transmission through the outer ear, the middle ear, and the inner ear. These models are associated with a high computational complexity, making real-time determination of such auditory patterns impractical or impossible. Moreover, these elaborate auditory models typically involve non-linear transformations, which present difficulties, particularly in applications that involve optimization of perceptually based objective functions. A perceptually based objective function is usually directed toward appropriately modifying the frequency spectrum to obtain a maximum perceptual benefit where the perceptual benefit is measured by incorporating an auditory model that generates the perceptual quantities (such as excitation and/or loudness patterns) for this purpose. The difficulty in solving the perceptually based objective functions lies in the fact that an optimal solution can be obtained only by searching the entire search space of candidate solutions. An alternative sub-optimal approach is based on following an iterative optimization technique. But in both cases, the evaluation of the auditory model has to be carried out multiple times and the computational complexity associated with the process is extremely high and often not suitable for real-time applications.

Accordingly, there is a need for a computationally efficient process that can determine a total loudness estimate, as well as auditory patterns such as the excitation pattern and the loudness pattern.

SUMMARY

Embodiments disclosed herein relate to the determination of an auditory pattern of an audio segment. The embodiments utilize an auditory model to determine perceptual quantities, such as excitation patterns, loudness patterns, and a total loudness estimate. The auditory model is based on the human ear. The auditory model includes an auditory scale that represents distances along the basilar membrane in an inner ear, such that equal lengths along the auditory scale correspond to equal lengths along the length of the basilar membrane. The auditory scale is measured in units of equivalent rectangular bandwidth (ERB). Every point, or location, along the basilar membrane has maximum sensitivity to a characteristic frequency. A frequency can therefore be mapped to its characteristic location on the auditory scale.

In one embodiment, a plurality of frequency components that describe the audio segment is generated. For example, the plurality of frequency components may comprise fast Fourier transform (FFT) coefficients identifying frequencies and magnitudes that compose the audio segment. Each of the frequency components can then be expressed equivalently in terms of its characteristic location on the auditory scale. Multiple locations on the auditory scale are selected as detector locations. In one embodiment, ten detector locations per ERB unit are selected. These detector locations represent sample locations on the auditory scale where an auditory pattern, such as the excitation pattern, or the loudness pattern, may be computed.

In one embodiment, the excitation pattern is determined based on a subset of the plurality of frequency components that describe the audio segment, or based on a subset of the detector locations on the auditory scale, or based on both the subset of the plurality of frequency components that describe the audio segment and the subset of the detector locations on the auditory scale. Because only a subset of frequency components and a subset of detector locations are used to determine the excitation pattern, the excitation pattern may be calculated substantially in real time. From the excitation pattern, a loudness pattern may be determined, and a total loudness estimate may be determined based on the loudness pattern. The audio signal may be altered based on the loudness pattern.

Initially, an average intensity at each of the plurality of detector locations on the auditory scale is determined. The average intensity may be based on the intensity at each of a set of detector locations that includes the respective detector location for which the average intensity is being determined. In one embodiment, the set of detector locations includes the detector locations within one ERB unit surrounding the respective detector location for which the average intensity is being determined.

Based on the average intensity corresponding to the detector locations, one or more tonal bands, each of which corresponds to a particular segment of the auditory scale, are identified. In one embodiment, a tonal band is identified where the average intensity at each detector location in a range of detector locations differs from any other detector location in the range of detector locations by less than 10 percent. In one embodiment, the number of detector locations in the range is the same as the number of detector locations in one ERB unit.

For each tonal band that is identified, a strongest frequency component of the plurality of frequency components that correspond to a location on the auditory scale within the range of detector locations of the tonal band is determined.

A plurality of non-tonal bands is also identified, each of which likewise corresponds to a particular segment of the auditory scale. Each non-tonal band may comprise a range of detector locations between two tonal bands. Each non-tonal band is divided into a plurality of sub-bands. For each sub-band, the intensity of the one or more frequency components that correspond to the sub-band is summed. A corresponding combined frequency component having an equivalent intensity to the total intensity of the combined sum of frequency component intensities is determined. If only a single frequency component corresponds to the sub-band, the single frequency component is used as the corresponding combined frequency component. If more than one frequency component corresponds to the sub-band, then a corresponding combined frequency component that is representative of the combined intensities of all the frequency components in the sub-band is generated.

The subset of frequency components used to determine the excitation pattern is the corresponding strongest frequency component from each tonal band, and the corresponding combined frequency component from each non-tonal sub-band.

The subset of detector locations used to determine the excitation pattern includes those detector locations that correspond to a maxima and those detector locations that correspond to a minima of the average intensity pattern function used to determine the average intensity at each of the detector locations.

The excitation pattern may then be determined based on the subset of frequency components and the subset of detector locations.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Embodiments disclosed herein relate to the determination of an auditory pattern, such as an excitation pattern of an audio segment. Based on the excitation pattern, a loudness pattern may be determined, and a total loudness estimate may be determined based on the loudness pattern. Using conventional techniques, determining an excitation pattern associated with an audio segment is computationally intensive, and impractical or impossible to determine in real time. Embodiments herein enable the determination of an excitation pattern in real time, enabling a number of novel applications, such as circuitry for driving a cochlear implant, hearing aid circuitry, gain control circuitry, sinusoidal selection processing, and the like. The embodiments utilize an auditory model to determine perceptual quantities, such as excitation patterns, loudness patterns, and a total loudness estimate. The auditory model is based on the human ear. The auditory model includes an auditory scale that represents distances along the basilar membrane in the inner ear, such that equal lengths along the auditory scale correspond to equal lengths along the length of the basilar membrane. Every point, or location, along the basilar membrane is sensitive to a characteristic frequency. A frequency can therefore be mapped to a location on the auditory scale.

Embodiments herein determine a plurality of detector locations d along the length of the auditory scale. While embodiments herein will be discussed in the context of ten detector locations d for each equivalent rectangular bandwidth (ERB) unit (sometimes referred to as a "critical bandwidth"), those skilled in the art will appreciate that the invention is not limited to any particular number of detector locations d per ERB unit, and can be used with a detector location d density greater or less than ten detector locations per ERB unit.

Figure 1:
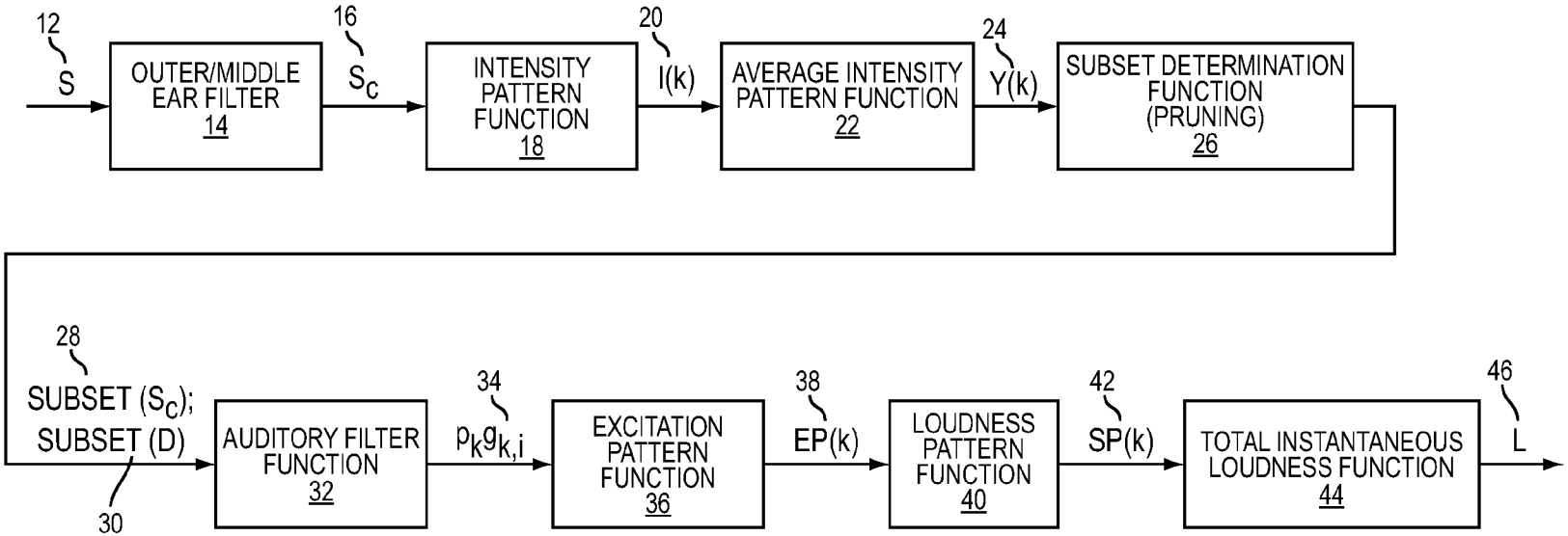
FIG. 1 is a block diagram illustrating at a high level a process for determining an excitation pattern, a loudness pattern, and a total loudness estimate according to one embodiment.

FIG. 1 is a block diagram illustrating at a high level a process for determining an excitation pattern, a loudness pattern, and a total loudness estimate according to one embodiment. A signal 12 (sometimes referred to herein as "S")

contains a plurality of frequency components that describes an audio signal in terms of frequency and magnitude. In one embodiment, the signal 12 may comprise the output coefficients generated by a fast Fourier transform (FFT) of the audio segment. Typically, embodiments herein operate on a discrete segment of an audio signal, such as, for example, a 23 millisecond (ms) audio segment, although it will be apparent to those skilled in the art that an audio segment may be more or less than 23 ms, as desired or appropriate for the particular application. The audio signal may comprise any sounds, such as music, one or more voices, or the like. The signal 12 is passed through an outer/middle ear filter 14 via known mechanisms and processes for altering a signal consistent with the manner in which the outer and middle ear alter an audio signal. The output signal 16 (sometimes referred to herein as "$S_c$") may comprise FFT coefficients that have been altered in accordance with the outer/middle ear filter 14. As used herein, the symbol $S_c$ may be used to refer to the total set of N frequency components that make up the audio segment of the output signal 16. The designation $S_c(i)$ may be used to refer to the particular frequency component identified by the index i in the total set of N frequency components that make up the output signal 16. Each frequency component $S_c(i)$ has a corresponding frequency (which may be referred to herein as $f_i$, and a magnitude).

The signal 16 is an input into an intensity pattern function 18 which generates an intensity pattern 20 (sometimes referred to herein as "I(k)") based on the intensity of the frequency components within one ERB unit surrounding each detector location d. The intensity pattern 20 represents the total power of the frequency components that are present within one ERB unit surrounding a detector location d. In one embodiment, the intensity pattern 20 may be calculated in accordance with the following formula:

$$I(k) = \sum_{i \in A_k} S_c(i), \quad \text{where } A_k = \{i \mid d_k - 0.5 < f_i^{erb} \le d_k + 0.5\} \tag{1}$$

wherein k represents a particular detector location d of D total detector locations, $A_k$ is the set of frequency components that correspond to locations on the auditory scale within one-half ERB unit on either side of the detector location $d_k$ (i.e., the frequency components within one ERB unit of the detector location $d_k$); $i \epsilon A_k$ is the set of indexes i that identify all the frequency components in the set $A_k$; $S_c(i)$ represents the magnitude of the ith frequency component of N total frequency components that compose the signal $S_c$; and $f_i^{erb}$ (in ERB units) is a designation that represents the location on the auditory scale to which a particular frequency component corresponds.

An average intensity pattern function 22 uses the intensity pattern 20 to determine an average intensity pattern 24 (sometimes referred to herein as Y(k)). The average intensity pattern 24 is based on the average intensity per ERB unit surrounding a particular detector location d. In one embodiment, the average intensity pattern 24 can be determined in accordance with the following formula:

$$Y(k) = \frac{1}{11} \sum_{m=-5}^{5} I(k-m), \quad \text{for } k = 1, \ldots, D \tag{2}$$

where I represents the intensity at a respective detector location $d_k$ according to the intensity pattern 20, D represents the total number of detector locations d, and k is an index into the set of detector locations d.

Note that the average intensity for a particular detector location $d_k$ is based on the intensity, determined by the intensity pattern function 18, of each detector location d in the set of detector locations d that are within one ERB unit surrounding the respective detector location $d_k$ for which the average intensity is being determined. Where, as discussed herein, the detector location density is ten detector locations d per ERB unit, the average intensity at a respective detector location $d_k$ may be based on the intensity at the set of detector locations d that include the five detector locations d on each side of the respective detector location $d_k$ for which the average intensity is being determined. However, it should be appreciated that the average intensity for a detector location $d_k$ could be determined on a set of detector locations d within less than one ERB unit surrounding the respective detector location $d_k$ or more than one ERB unit surrounding the respective detector location $d_k$.

Alternately, the average intensity can be realized in a more computationally efficient manner by using the filter's transfer function, H(z), as, $$H(z) = \frac{1}{11} \frac{z^5 - z^{-5}}{1 - z^{-1}}$$

wherein H(z) is the Z-transform of the average intensity pattern function 22.

The average intensity pattern 24 (Y(k)), as discussed in greater detail herein, is used by a subset determination function 26 to "prune" the total number of N frequency components $S_c$ to a frequency component subset 28 of frequency components $S_c$, and to prune the total number D detector locations d to a detector location subset 30 of detector locations d. Through the use of the frequency component subset 28 and the detector location subset 30 of detector locations d, an excitation pattern may be determined in a computationally efficient manner such that a loudness pattern and total loudness estimate may be determined substantially in real time.

The auditory model models the inner ear as a bank of overlapping bandpass auditory filters whose bandwidths correspond to critical bandwidths, e.g., one ERB unit. Each detector location $d_k$ represents the center of an auditory filter. Each auditory filter has a rounded top and an upper skirt and a lower skirt defined, respectively, by an upper slope parameter $p^u$ and lower slope parameter $p^l$. An auditory filter function 32 determines an auditory filter slope 34 (sometimes referred to herein as "p") for each auditory filter. Generally, the upper skirt parameter $p^u$ does not change based on the intensity of the signal $S_c$, however, the lower skirt parameter $p^l$ may change as a function of the intensity of the signal $S_c$. Whether to use the upper skirt parameter $p^u$ or the lower skirt parameter $p^l$ is based on the sign of the normalized deviation $g_{k,i}$, in accordance with the following formula:

$$p_k = \begin{cases} p^u & \text{if } g_{k,i} \ge 0 \\ p^l & \text{if } g_{k,i} < 0 \end{cases}$$

wherein $p_k$ is the auditory filter slope 34 of the auditory filter p at detector location $d_k$; $p^u$ is the upper skirt parameter; $p^l$ is the lower skirt parameter; and $g_{k,i}$ is the normalized deviation of the distance of each frequency component $S_c$ at index i from the detector location $d_k$.

The upper and lower skirt parameters $p^u$, $p^l$ can be determined in accordance with the following formulae:

$$p^l=p^{51}-0.38(p^{51}/p_{1000}{}^{51})(I(k)-51)$$

$$p^u=p^{51}$$

wherein I(k) is the intensity at the detector location $d_k$, and $p^{51}$ and $p_{1000}{}^{51}$ are constants given by:

$$p^{51}=4cf_k/CB(cf_k)$$

$$p_{1000}{}^{51}=4cf_k/CB(1000)$$

wherein k represents the index of the detector location $d_k$, and $cf_k$ represents the frequency (in Hz) corresponding to the detector location $d_k$ (in ERB units), and the critical bandwidth CB(f) represents the critical bandwidth (in Hz) associated with a center frequency f (in Hz) and can be determined in accordance with the following formula:

$$CB(f) = 24.67\left(4.368\frac{f}{1000}+1\right)$$

wherein f is the frequency in Hz.

Conventionally, the auditory filter function 32 evaluates the auditory filter slopes p of the auditory filters for all detector locations d because the auditory filter slopes p change as a function of the intensity pattern 20 and for each auditory filter, a set of normalized deviations for each frequency component $S_c(i)$ is calculated. Consequently, the auditory filter function 32 is associated with O(ND) complexity, and is relatively processor intensive. Because embodiments herein reduce the number of frequency components $S_c$ to the frequency component subset 28 and the number of detector locations d to the detector location subset 30, the auditory filter function 32 can determine the auditory filter slopes p and their normalized deviations g substantially in real time.

The auditory filter slopes 34 are used by an excitation pattern function 36 to generate an excitation pattern 38 (sometimes referred to hereinafter as "EP(k)"). The excitation pattern 38 is evaluated as the sum of the responses from the effective power spectrum $S_c(i)$ reaching the inner ear to each and every auditory filter that are centered at the detector locations d. According to one embodiment, the excitation pattern 38 may be determined in accordance with the following formula:

$$EP(k) = \sum_{i=1}^{N} (1 + p_k g_{k,i})\exp(-p_k g_{k,i})S_c(i), \quad \text{for } 1 \le k \le D \tag{3}$$

wherein $p_k$ is the auditory filter slope 34 of the auditory filter at the detector location $d_k$, $g_{k,i}$ is the normalized deviation between each frequency $f_i$ of the frequency component $S_c(i)$ and detector location $d_k$, $S_c(i)$ is the particular frequency component $S_c$ corresponding to the index i; and N is the total number of frequency components $S_c$. According to one embodiment, the normalized deviation may be determined according to $g_{k,i}=|(f_i-cf_k)/cf_k|$, A loudness pattern function 40 uses the excitation pattern 38 to determine a specific loudness pattern 42 (sometimes referred to hereinafter as "SP(k)"). The specific loudness pattern 42 represents the loudness density (i.e., loudness per ERB unit), or the neural activity pattern, and in one embodiment is determined in accordance with the following formula:

$$SP(k)=c((EP(k)+A(k)^{\alpha}-A(k)^{\alpha}), \text{ for k=1, . . . , } D \tag{4}$$

wherein c=0.047, α=0.2, k is an index into the detector locations d, D is the total number of detector locations d, and A(k) is a constant which is a function of the peak excitation level at the absolute threshold of hearing.

A total instantaneous loudness function 44 determines the area under the specific loudness pattern 42 to determine a total instantaneous loudness 46 (sometimes referred to hereinafter as "L"). The total instantaneous loudness 46 in conjunction with the excitation pattern 38 and the specific loudness pattern 42 may be used by control circuitry to, for example, alter characteristics of the original input signal 12 to increase, or decrease, the total instantaneous loudness associated with the input signal 12. The total instantaneous loudness 46, the excitation pattern 38 and the specific loudness pattern 42 may be used in a number of applications, including, for example, speech and audio applications including bandwidth extension, speech enhancement, hearing aids, speech and audio coding, and the like.

Figure 2A:
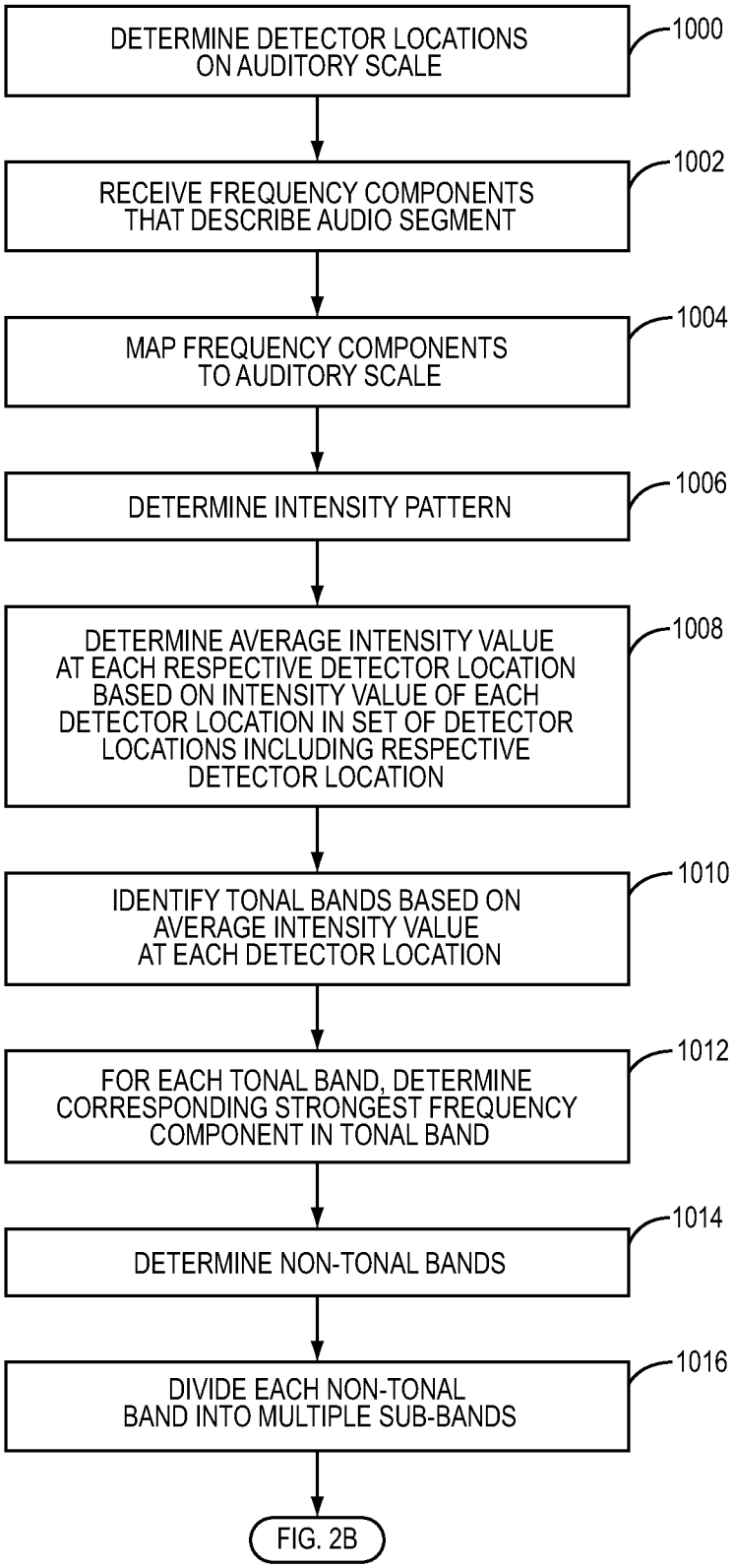
FIGS. 2A and 2B are flowcharts illustrating an exemplary process for determining an excitation pattern, a loudness pattern, and a total loudness estimate according to one embodiment.
Figure 2B:
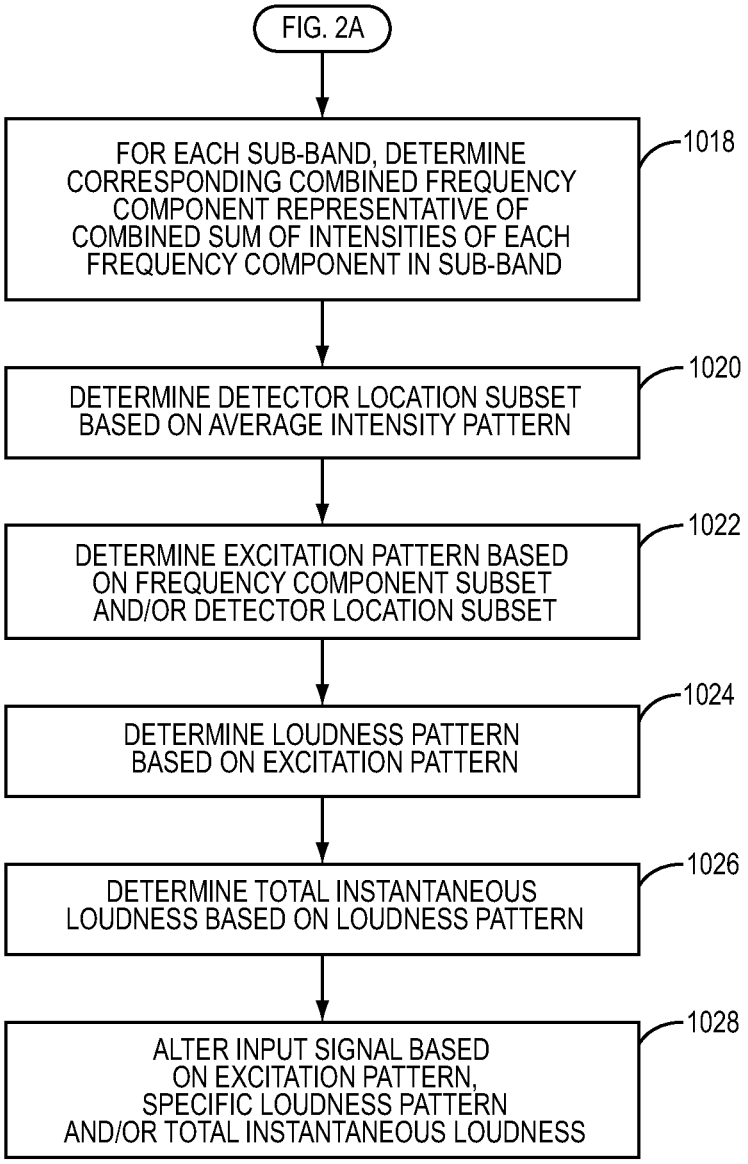

FIGS. 2A and 2B are flowcharts illustrating an exemplary process for determining an excitation pattern, a specific loudness pattern, and a total loudness estimate according to one embodiment.

Figure 3:
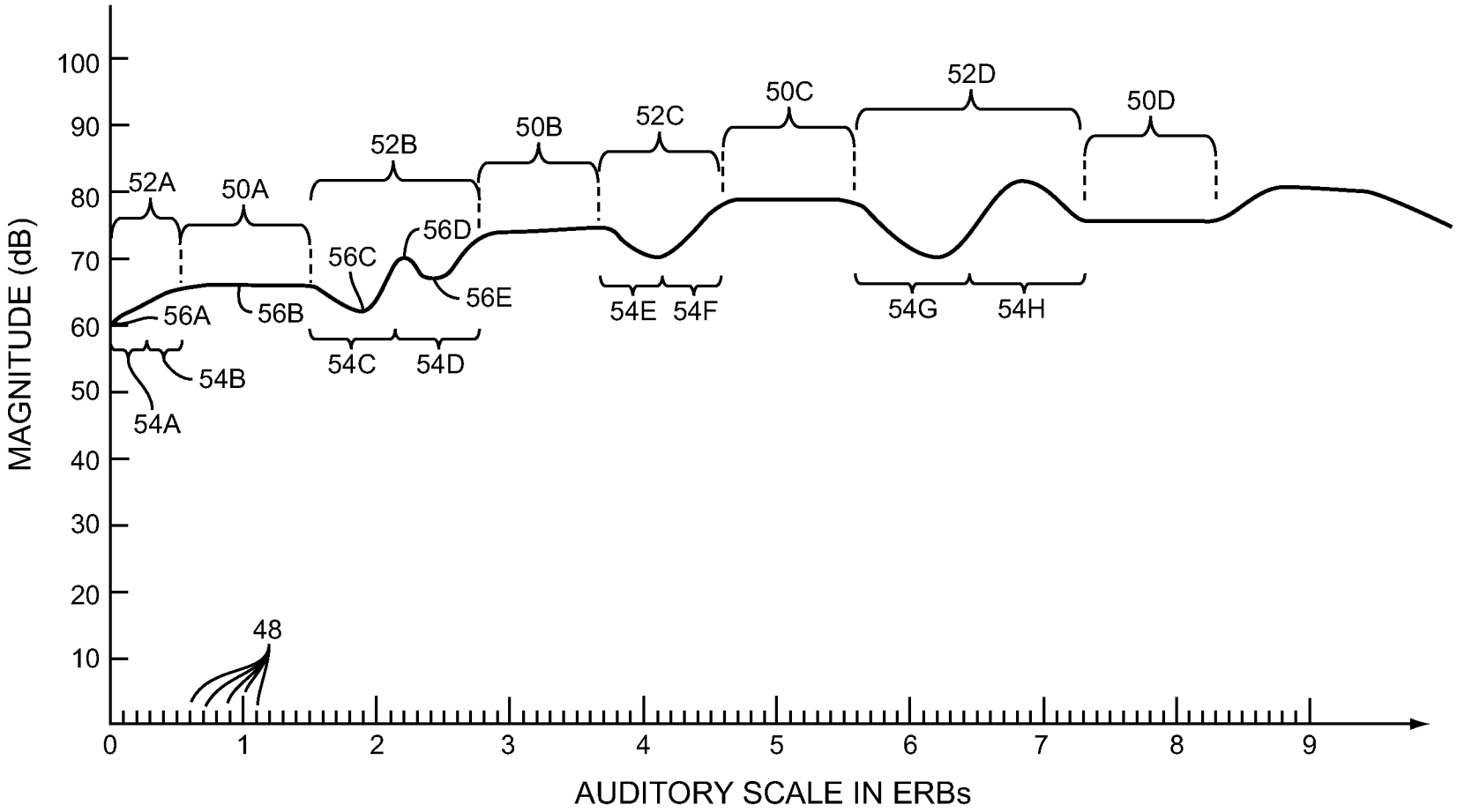
FIG. 3 is a graph of an exemplary average intensity pattern for a portion of an audio segment according to one embodiment.

Initially, a number of detector locations d are determined on the auditory scale (step 1000). The ERB auditory scale will be discussed herein, however, the invention is not limited to any particular auditory scale. As shown in FIG. 3, ten detector locations 48 will correspond to each ERB unit, however, the invention is not limited to any particular detector location density. The frequency components $S_c$ that describe the frequency and magnitude of the audio segment are received (step 1002). As discussed previously, frequency components $S_c$ may comprise FFT coefficients after being altered in accordance with the outer/middle ear filter 14 (FIG. 1). Each of the frequency components $S_c$ may be mapped to a particular location on the auditory scale in accordance with the following formula:

$$\text{loc(in ERB units)}=21.4\log_{10}(4.37f/1000+1)$$

wherein f is the frequency corresponding to the frequency component $S_c$ (step 1004).

It should be noted that a particular frequency component $S_c$ may correspond to a location on the auditory scale that is the same as a detector location 48, or may correspond to a location on the auditory scale between two detector locations 48.

The intensity pattern function 18 determines an intensity pattern 20 of the audio segment in accordance with formula (1) described above (step 1006). The average intensity pattern function 22 then determines the average intensity value based on the intensity pattern 20 in accordance with formula (2) described above (step 1008).

FIG. 3 is a graph of an exemplary average intensity pattern 24 for a portion of an audio segment according to one embodiment. For purposes of illustration, the graph illustrates the average intensity pattern 24 for ERBs 0-8, but it should be apparent to those skilled in the art that the average intensity pattern 24 extends to the maximum number of ERB units in accordance with the auditory scale. The remainder of FIGS. 2A and 2B will be discussed in conjunction with FIG. 3.

One or more tonal bands 50 (e.g., tonal bands 50A-50D) are identified based on the average intensity value at each detector location d (step 1010). In one embodiment, the tonal bands 50 are identified based on the average intensity value at consecutive detector locations d over a length of one ERB unit. For example, where the average intensity values at consecutive detector locations d over a length of one ERB unit differ from each other by less than 10%, a tonal band 50 may be identified. For example, the tonal band 50A is identified based on the determination that the average intensity value at consecutive detector locations 0.5 through 1.5 varies by less than 10%. In another embodiment, the tonal bands 50 may be identified based on the determination that the average intensity values at consecutive detector locations over a length of one ERB unit differ by less than 5%. While a length of one ERB unit is used to determine a tonal band 50, the invention is not limited to tonal bands 50 of one ERB unit, and the tonal bands could comprise a length of more or less than one ERB unit. As another example, the tonal band 50D is identified based on the determination that the average intensity values at consecutive detector locations 7.2 through 8.2 differ by less than 10%.

For each tonal band 50, a corresponding strongest frequency component $S_c$ having the greatest magnitude of all the frequency components $S_c$ that are located within the respective tonal band 50 is identified (step 1012). The selected corresponding strongest frequency component is made a member of the frequency component subset 28.

Non-tonal bands 52A-52D are determined based on the tonal bands 50*a*-50*d* (step 1014). Each non-tonal band 52 comprises a range of detector locations d between two tonal bands 50. For example, the non-tonal band 52*a* comprises the band of detector locations d between the beginning of the ERB scale and the tonal band 50A (i.e., approximately the detector locations d at 0-0.5 on the auditory scale). The non-tonal band 52B comprises the band of detector locations d between the tonal band 50A and the tonal band 50B.

Each non-tonal band 52 is divided into a plurality of sub-bands 54 (step 1016). For purposes of illustration, each non-tonal band 52 is illustrated in FIG. 3 as being divided into two sub-bands 54, which Applicants believe provides a suitable balance between accuracy and efficiency, however embodiments are not limited to any particular number of sub-bands 54. For each sub-band 54, a corresponding combined frequency component is determined that has an intensity representative of the combined intensity of all frequency components that are located in the respective sub-band 54. If only a single frequency component is located in the sub-band 54, the single frequency component is selected as the corresponding combined frequency component. If more than one frequency component is located in the sub-band 54, a corresponding combined frequency component $\hat{S}_p$ may be determined in accordance with the following formula:

$$\hat{S}_p = \sum_{j \in M_p} S_c(j)$$

wherein $M_p$ is the set of indices of all frequency components $S_c$ that are located in the sub-band 54 (step 1018).

The corresponding combined frequency component $\hat{S}_p$ is added to the frequency component subset 28.

The detector location subset 30 may be determined based on the detector locations d that are located at the maxima and minima of the average intensity pattern 24 (step 1020). For example, the detector location subset 30 may include detector locations d that correspond to the maxima and minima 56A-56E. While only five maxima and minima 56A-56E are illustrated, it will be apparent that there are several additional maxima and minima in the portion of the average intensity pattern 24 illustrated in FIG. 3.

The excitation pattern function 36 determines the excitation pattern 38 based on the frequency component subset 28, the detector location subset 30, or both the frequency component subset 28 and the detector location subset 30 in accordance with formula (3) discussed above (step 1022). Because the excitation pattern 38 is determined based on a subset of frequency components $S_c$ and a subset of detector locations d, the auditory filter slope processing associated with the auditory filter function 32 is greatly reduced, enabling the computation of the excitation pattern 38 substantially in real time.

The loudness pattern function 40 determines the specific loudness pattern 42 based on the excitation pattern 38 (step 1024) in accordance with formula (4), as discussed above. The total instantaneous loudness function 44 then determines the total instantaneous loudness 46 as discussed above (step 1026). In one embodiment, the total instantaneous loudness 46 may be used to alter an input signal to decrease or increase the total instantaneous loudness 46 of the input signal (step 1028).

Embodiments herein substantially decrease the processing complexity, and therefore the time associated therewith, for determining the excitation pattern 38, the specific loudness pattern 42, and the total instantaneous loudness 46.

Figure 4:
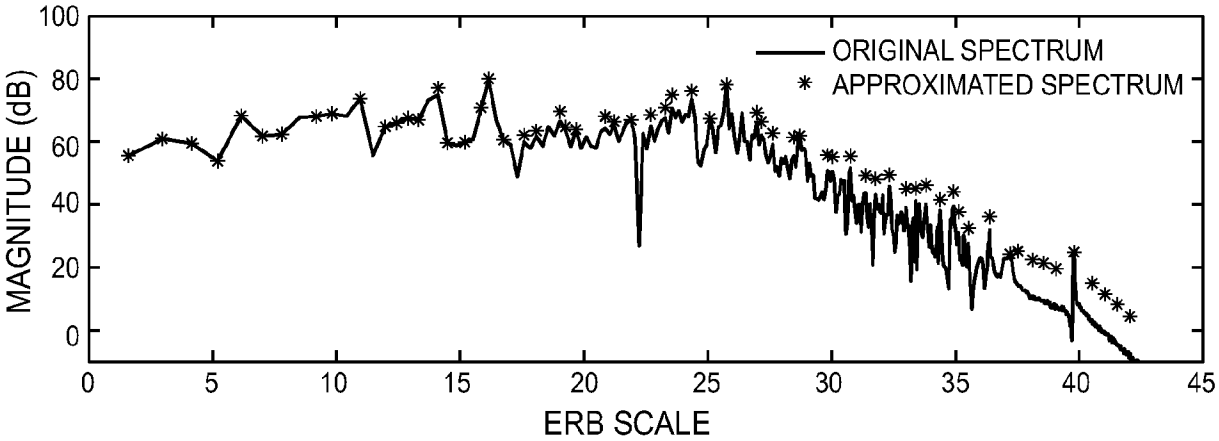
FIG. 4 is a graph illustrating an original spectrum associated with an actual audio segment of an input signal and an approximated spectrum based on a frequency component subset.

FIG. 4 is a graph illustrating an original spectrum associated with an actual audio segment of an input signal and an approximated spectrum based on the frequency component subset 28.

Figure 5:
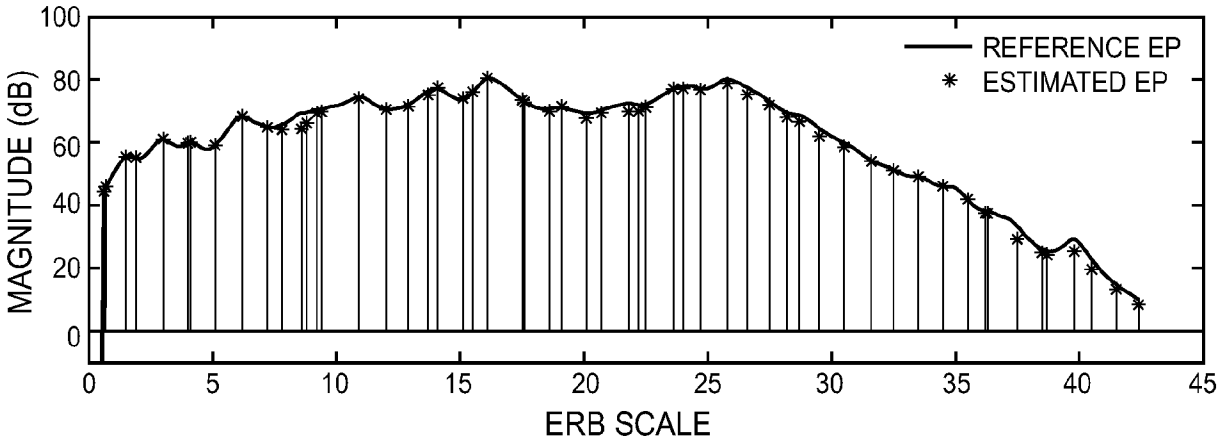
FIG. 5 is a graph illustrating an excitation pattern associated with an audio segment that was determined with a full set of frequency components and detector locations, and an estimated excitation pattern generated with a frequency component subset and a detector location subset.

FIG. 5 is a graph illustrating an excitation pattern associated with an audio segment that was determined with a full set of frequency components and detector locations d, and an estimated excitation pattern 38 generated with the frequency component subset 28 and the detector location subset 30.

Figure 6:
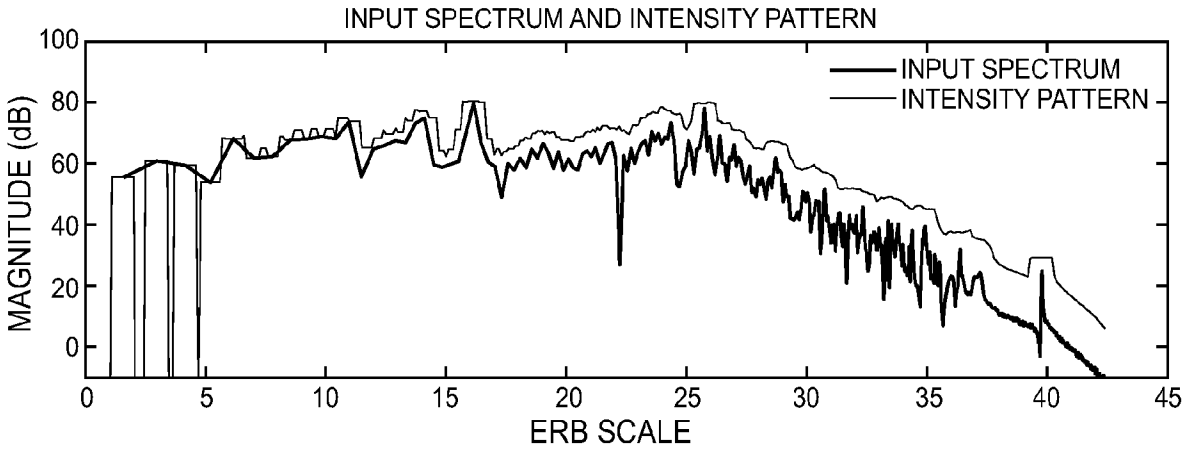
FIG. 6 is a graph illustrating an input spectrum associated with an audio segment, and an intensity pattern of the audio segment.

FIG. 6 illustrates an input spectrum associated with an audio segment, and an intensity pattern 20 of the audio segment.

Figure 7:
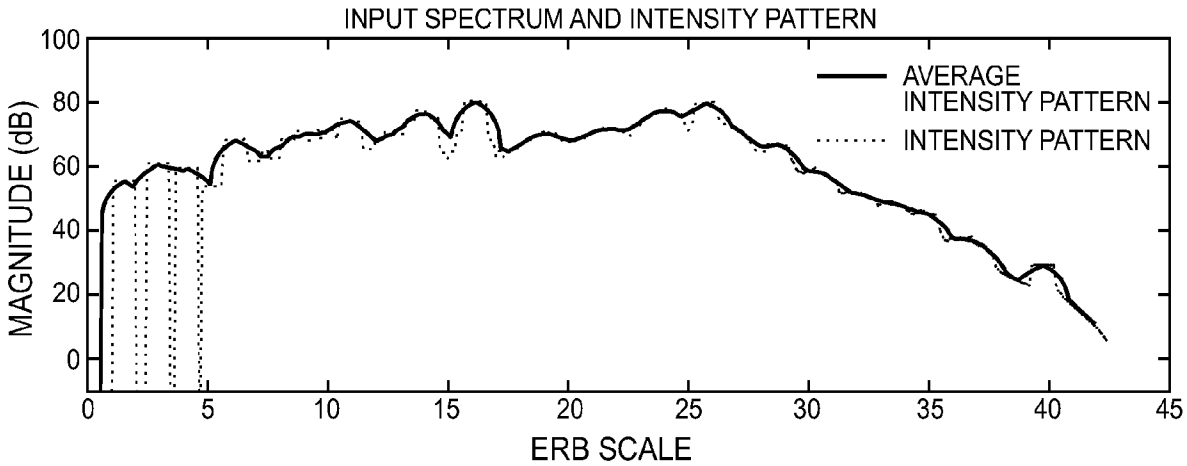
FIG. 7 is a graph illustrating an average intensity pattern of an audio segment according to one embodiment, and an intensity pattern of the same audio segment.

FIG. 7 illustrates an average intensity pattern 24 of an audio segment according to one embodiment, and an intensity pattern 20 of the same audio segment.

Applicants conducted evaluations and simulations of the embodiments disclosed herein in the following manner. Audio signals were sampled at 44.1 KHz and audio segments of 23 ms durations were used. Each audio segment was referenced randomly to an assumed Sound Pressure Level (SPL) between 30 and 90 dB to evaluate the performance of the embodiments discloses herein at different sound levels. Spectral analysis was done using a 1024 point FFT (i.e., N=513). A reference set of D=420 detector locations are uniformly spaced on the ERB scale. The experiments were performed on a 2 GHz Intel Core 2 duo processor with 2 GB RAM.

Let $N_r$ denote the average number of frequency components in the frequency component subset 28, and $D_r$ denote the average number of detector locations d in the detector location subset 30. The performance of the embodiments disclosed herein was measured in terms of the percentage reduction in the number of frequency components and detector locations, i.e., $(N-N_r)/N$) and $(D-D_r)/D$. The results are tabulated in Table 1. An average reduction of 88% and 80% was obtained for the frequency component pruning and detector location pruning approaches respectively. This results in an average reduction of 97%

$$\left(=1-\frac{NrD_r}{ND}\right)$$

for the excitation pattern and auditory filter evaluation stages, which have an O(ND) complexity.

TABLE 1

Frequency and Detector Pruning Evaluation Results for Q (sub-bands) = 2

| Type | Number of Components Maximum | Minimum | Average | Percent Reduction |
|---|---|---|---|---|
| Frequency Component Subset | 66 | 56 | $N_r = 63$ | 88% |
| Detector Location Subset | 102 | 81 | $D_r = 87$ | 80% |

In Table 2, a comparison of computational (central processing unit) time is shown, where the proposed approach achieves a 95% reduction in computational time for the auditory filter function 32 and excitation pattern function 36 processing.

TABLE 2

Computational Time: Comparison Results

| Stage | Computational Time (in seconds) Reference | Using Subsets | Reduction |
|---|---|---|---|
| Auditory Filter Function | 0.407 | 0.01942 | 95% |
| Excitation Pattern Function | | | |
| Loudness Pattern | 0.00128 | 0.00064 | 50% |

One metric used by Applicants to measure the efficacy of the embodiments herein utilizes an absolute loudness error metric ($|L_r-L_e|$), and a relative loudness error metric ($|L_r-L_e|/L_r$), to evaluate the performance of the embodiments disclosed herein, wherein $L_r$ and $L_e$ represent the reference and estimated loudness (in sones), respectively.

The results are tabulated in Table 3 for different types of audio signals. It can be observed that the determination of and use of the frequency component subset 28 and detector location subset 30 yields a very low average relative loudness error of about 5%.

TABLE 3

Loudness Estimation Algorithm: Evaluation Results

| Type | Loudness Error $\|L_r - L_e\|$(in sones) Maximum | Minimum | Average | Relative Error |
|---|---|---|---|---|
| Single Instruments | 2.6 | 0.002 | 0.40 | 4.63% |
| Speech & Vocal | 2.42 | 0.00312 | 0.41 | 3.80% |
| Orchestra | 2.49 | 0.00662 | 0.42 | 5.18% |
| Pop Music | 2.59 | 0.00063 | 0.45 | 4.25% |
| Band-limited Noise | 4.4 | 0.09 | 1.02 | 7% |

Many different applications may benefit from the method for determining the excitation pattern 38, the specific loudness pattern 42, and the total instantaneous loudness 46 described herein. One such application is an audio gain control circuit. In one embodiment, a loudness control mechanism utilizing the embodiments described herein modifies the intensities of the spectral components of the audio signal so that the modified audio signal has a loudness that is close to a predetermined level, thereby creating a better listening experience.

Figure 8:
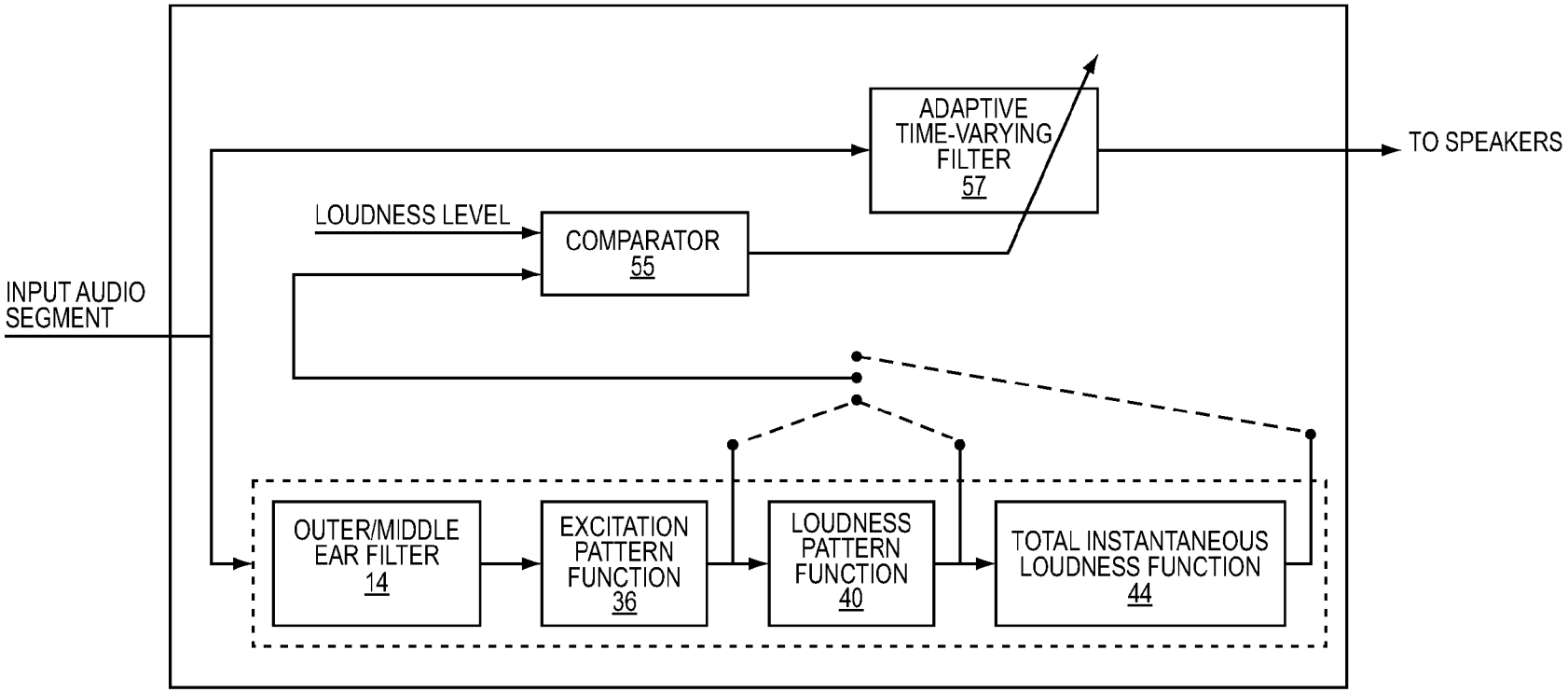
FIG. 8 is a high-level block diagram of an audio gain control circuit according to one embodiment.

FIG. 8 is a high-level diagram of such an audio gain control circuit according to one embodiment. In particular, an incoming audio segment of a audio receiver or television, for example, is analyzed and an excitation pattern 38, a specific loudness pattern 42, and a total instantaneous loudness 46 are determined. Assume an expected output loudness is preset to a fixed level, or threshold. A comparator 55 compares the total instantaneous loudness 46 to the expected output loudness. The loudness difference between the total instantaneous loudness 46 and the expected output loudness can be used to drive an adaptive time-varying filter 57 that modifies the spectral components, such as the frequency components $S_c$, associated with the input audio signal so that the resulting audio signal has a loudness that is at or substantially near the expected output loudness.

Figure 9:
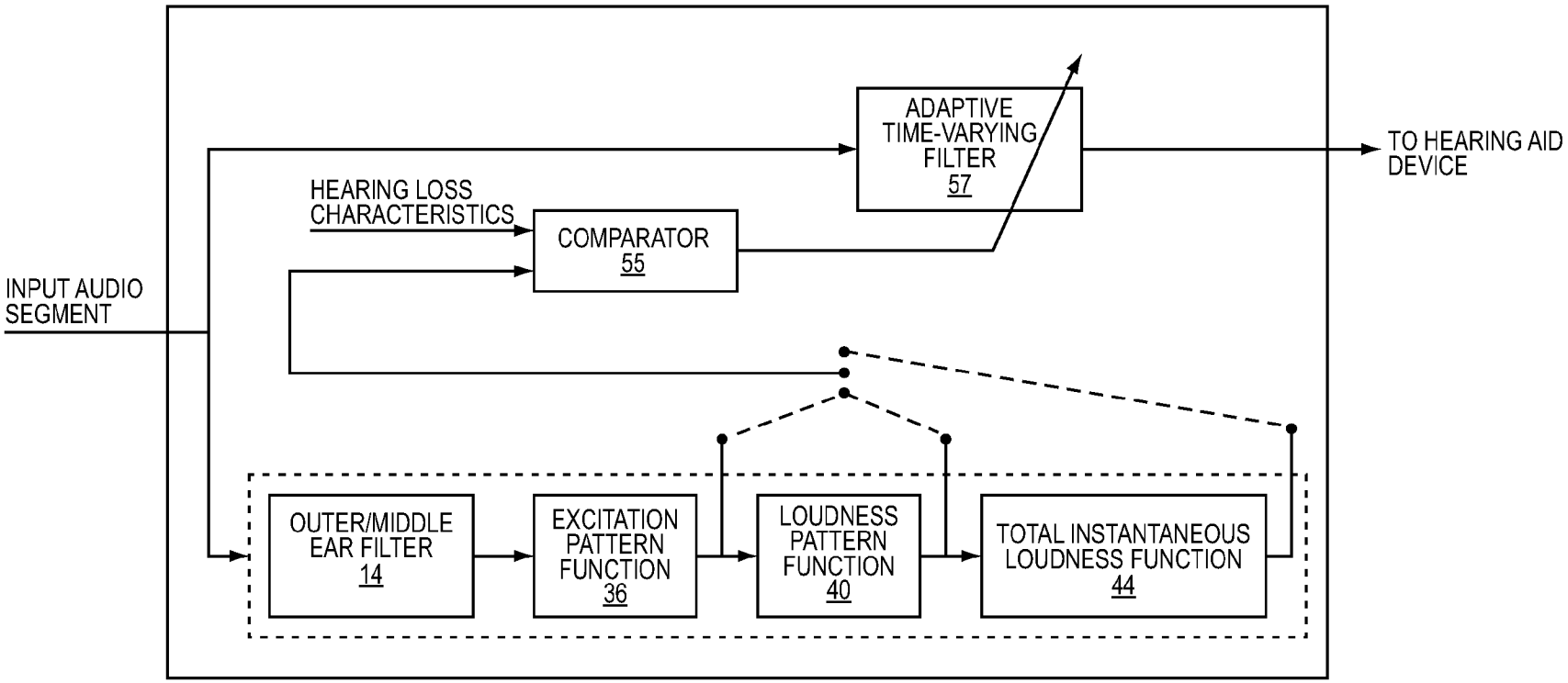
FIG. 9 is a high-level block diagram of a hearing aid circuit according to one embodiment.

In another embodiment, a loudness estimation circuit mimics the stages of the human auditory system in part by determining the excitation pattern 38, the specific loudness pattern 42, and the total instantaneous loudness 46 described herein. A user's hearing loss characteristics together with the excitation pattern 38, the specific loudness pattern 42, and the total instantaneous loudness 46 may be used by the adaptive time-varying filter 57 to modify the spectral components, such as the frequency components $S_c$, of the incoming audio so that the resulting audio signal is perceived for a hearing aid user as it would have been for a person with normal hearing. FIG. 9 is a high-level block diagram of such a hearing aid circuit. Such circuitry may also be suitable for driving a cochlear implant by generating the excitation pattern 38, the specific loudness pattern 42, and/or the total instantaneous loudness 46 described herein, which collectively represent the electrical stimulation that is transmitted to the brain to create an associated perception.

In both hearing aid and cochlear-implant-based devices, the circuitry and processing may be implemented in a Digital Signal Processor (DSP) that performs digital filtering operations on the incoming signals in real time. Moreover, because such devices are typically battery operated, reducing power consumption may be very valuable. Notably, the embodiments herein reduce the time and processing power associated with determining the excitation pattern 38, the specific loudness pattern 42, and the total instantaneous loudness 46 of an audio segment.

In yet another embodiment, embodiments herein may be used for sinusoidal component selection. The sinusoidal component selection may be implemented in a conventional one or more sinusoidal modeling frameworks which are currently used in speech and audio coding standards. For example, the MPEG-4 standard includes an audio coding scheme referred to as the HILN (Harmonics plus Individual Lines and Noise), which is based on a sinusoidal modeling framework. The idea behind the sinusoidal model is to represent an audio signal as a linear combination of a set of sinusoidal components. These models have gained popularity in Internet streaming applications owing to their ability to provide high-quality audio at low bit-rates.

In low bit-rate and streaming applications, only a limited number of sinusoidal parameters can be transmitted. In such situations, a goal is to select a subset of sinusoids deemed perceptually most relevant. For example, the sinusoids that provide the maximal increment of loudness may be selected. Simply expressed, the goal is to select k sinusoids out of the n total sinusoids.

Due to the non-linear aspects of the conventional perceptual model, it is not straightforward to select this subset of k sinusoids from the n sinusoids directly. An exhaustive search is required to select the k sinusoids; for example, to select k=2 sinusoids from n=4 sinusoids, the loudness of each of the following sinusoidal combinations must be tested: {(1,2), (1,3), (1,4), (2,3), (2,4), (3,4)}. This implies that the total instantaneous loudness 46 must be determined for six iterations. For larger n and k, this selection process can become computationally intensive. In particular, the computational complexity is combinatorial and varies as n-choose-k operations. Use of the embodiments herein greatly reduces the number of sinusoidal components, and thus greatly reduces the processing required to determine the most perceptually relevant sinusoids.

Figure 10:
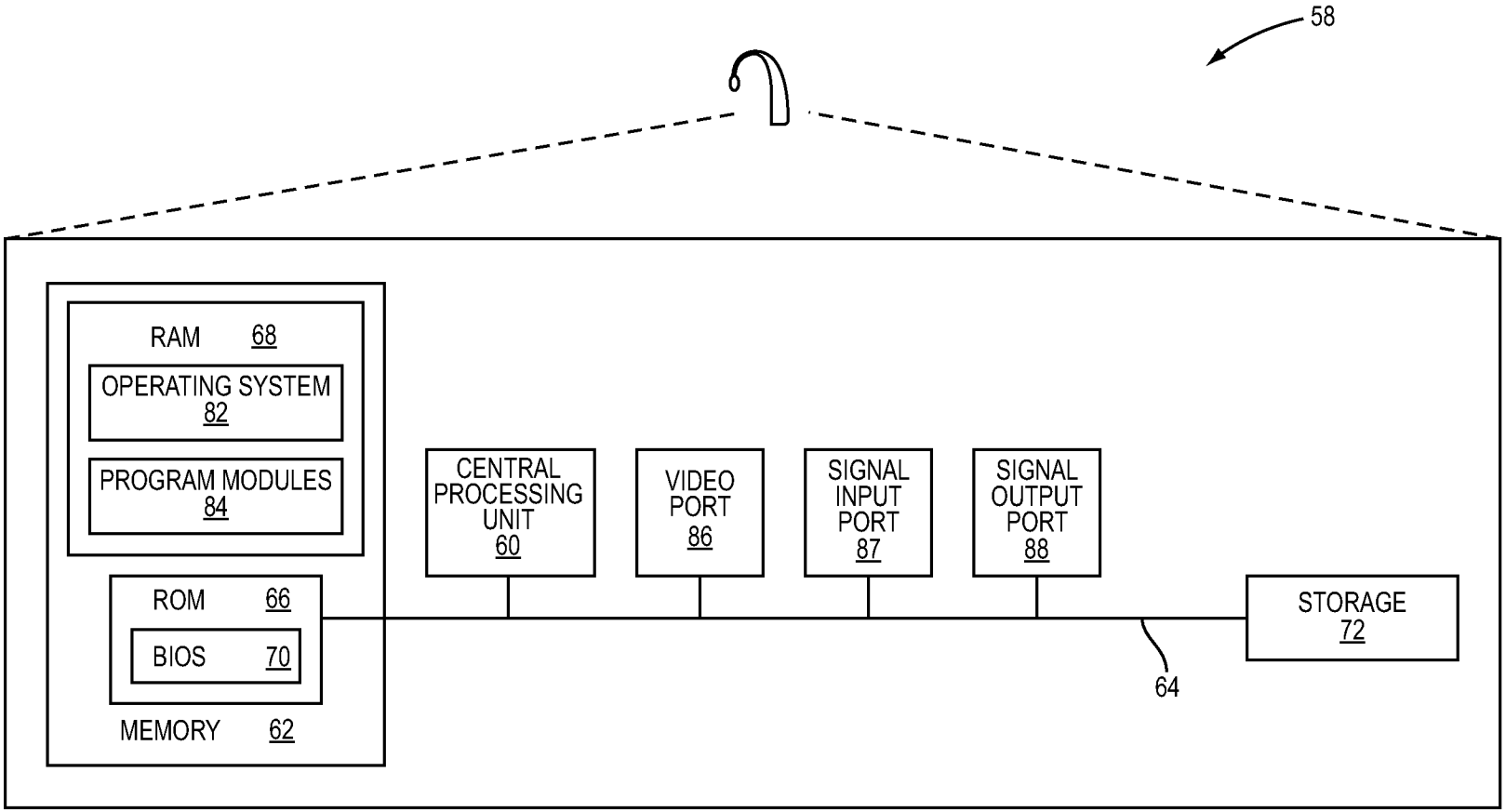
FIG. 10 is a block diagram of an exemplary processing device for implementing embodiments described herein according to one embodiment.

FIG. 10 is a block diagram of an exemplary processing device 58 for implementing embodiments described herein according to one embodiment. The processing device 58 may comprise, for example, a hearing aid, a computer, a controller for a cochlear implant, a sound processor for a home theater or stereo receiver, or the like. The exemplary processing device 58 for may also include a central processing unit 60, a system memory 62, and a bus 64. The bus 64 provides an interface for system components including, but not limited to, the system memory 62 and the central processing unit 60. The central processing unit 60 can be any of various commercially available or proprietary processors. Dual microprocessors and other multi-processor architectures may also be employed as the central processing unit 60.

The bus 64 can be any of several types of bus structures that may further interconnect to a memory bus (with or without a memory controller), a peripheral bus, and/or a local bus using any of a variety of commercially available bus architectures. The system memory 62 can include non-volatile memory 66 (e.g., read only memory (ROM), erasable programmable read only memory (EPROM), electrically erasable programmable read only memory (EEPROM), etc.) and/or volatile memory 68 (e.g., random access memory (RAM)). A basic input/output system (BIOS) 70 can be stored in the non-volatile memory 66, and can include the basic routines that help to transfer information between elements within the processing device 58. The volatile memory 68 can also include a high-speed RAM such as static RAM for caching data.

The processing device 58 may further include a storage 72, which may comprise, for example, an internal hard disk drive (HDD) (e.g., enhanced integrated drive electronics (EIDE) or serial advanced technology attachment (SATA)) for storage, flash memory, or the like. The drives and associated computer-readable and computer-usable media provide non-volatile storage of data, data structures, and computer-executable instructions for performing functionality described herein.

A number of program modules can be stored in the drives and volatile memory 68, including an operating system 82 and one or more program modules 84, which implement the functionality described herein, including, for example, functionality associated with determining the excitation pattern 38, the specific loudness pattern 42, and the total instantaneous loudness 46, and other processing and functionality described herein. It is to be appreciated that the embodiments can be implemented with various commercially available or proprietary operating systems or combinations of operating systems. All or a portion of the embodiments may be implemented as a computer program product, such as a computer-usable or computer-readable medium having a computer-readable program code embodied therein. The computer-readable program code can include software instructions for implementing the functionality of the embodiments described herein. The central processing unit 60, in conjunction with the program modules 84 in the volatile memory 68, may serve as a control system for the processing device 58 that is configured to, or adapted to, implement the functionality described herein.

The processing device 58 may drive a separate or integral display device, which may also be connected to the system bus 64 via an interface, such as a video port 86. The processing device 58 may include a signal input port 87 for receiving the signal 12 or output signal 16 comprising frequency components, or may receive an audio signal and generate the frequency components from the audio signal. The processing device 58 may include a signal output port 88 for sending an audio signal that has been modified based on the excitation pattern 38, the specific loudness pattern 42, or the total instantaneous loudness 46. For example, the processing device 58 may be used to ensure an audio signal is within a predetermined instantaneous loudness window, and if the input audio signal is not, may alter the audio signal to generate an audio signal that is within the predetermined instantaneous loudness window.

The Appendix to this specification includes the provisional application referenced above within the "Related Applications" section in its entirety, and also provides further details and alternate embodiments. The Appendix is incorporated herein by reference in its entirety.

Those skilled in the art will recognize improvements and modifications to the preferred embodiments of the present disclosure. All such improvements and modifications are considered within the scope of the concepts disclosed herein and the claims that follow.

What is claimed is:

1. A computer-implemented method for determining an auditory pattern associated with an audio segment, comprising:

receiving, by a processor, a first plurality of frequency components that describe the audio segment in terms of frequency and magnitude, wherein each of the first plurality of frequency components corresponds to one of a plurality of detector locations on an auditory scale;

determining an average intensity pattern function at each of a first plurality of detector locations on the auditory scale, wherein the average intensity pattern function is determined using at least one of the first plurality of frequency components;

determining a second plurality of frequency components, wherein the second plurality of frequency components is determined based on at least one of the average intensity pattern function and the first plurality of frequency components, wherein locations of the second plurality of frequency components are time-varying;

determining a detector location subset based on the average intensity pattern function; and determining an auditory pattern based on at least one of the second plurality of frequency subset components and the detector location subset.

2. The method of claim 1, wherein the auditory pattern comprises an excitation pattern.

3. The method of claim 1, wherein the auditory pattern comprises a specific loudness excitation pattern.

4. The method of claim 1, wherein determining the second plurality of frequency components comprises:

determining, based on the average intensity pattern function, a plurality of tonal bands in the audio segment, wherein each tonal band comprises a particular range of detector locations of the first plurality of detector locations;

for each of the plurality of tonal bands, selecting a corresponding strongest frequency component from the first plurality of frequency components that corresponds to a location within the particular range of detector locations corresponding to the each of the plurality of tonal bands;

determining a plurality of non-tonal bands in the audio segment;

for each of the plurality of non-tonal bands, dividing the each of the plurality of non-tonal bands into a plurality of sub-bands, and for each of the plurality of sub-bands determining a corresponding combined frequency component that is representative of a combined sum of intensities of the first plurality of frequency components that is in the corresponding sub-band; and determining an excitation pattern based on the at least one of the second plurality of frequency components and the detector location subset comprises determining the excitation pattern based on the corresponding strongest frequency components and the corresponding combined frequency components.

5. The method of claim 4, wherein determining the corresponding combined frequency component that is representative of the combined sum of intensities of the first plurality of frequency components that is in the corresponding sub-band further comprises summing the intensities of the first plurality of frequency components that is in the corresponding sub-band and generating the corresponding combined frequency component based on the summing of the intensities.

6. The method of claim 4, wherein each tonal band comprises one equivalent rectangular bandwidth (ERB) unit.

7. The method of claim 6, wherein at least some of the non-tonal bands comprise more than one ERB unit.

8. The method of claim 4, further comprising determining the detector location subset, wherein the detector location subset comprises a second plurality of detector locations of the first plurality of detector locations wherein each of the second plurality of detector locations comprises either a maxima or a minima of the average intensity pattern function; and determining the excitation pattern based on the corresponding strongest frequency components and the corresponding combined frequency components comprises determining the excitation pattern based on the corresponding strongest frequency components, the corresponding combined frequency components, and the detector location subset.

9. The method of claim 1, wherein the detector location subset comprises a second plurality of detector locations of the first plurality of detector locations wherein each of the second plurality of detector locations comprises either a maxima or a minima of the average intensity pattern function; and wherein determining the auditory pattern based on the at least one of the second plurality of frequency components and the detector location subset comprises determining the auditory pattern based on the detector location subset.

10. The method of claim 1, further comprising determining a specific loudness pattern associated with the audio segment based on the auditory pattern.

11. The method of claim 10, further comprising determining a total instantaneous loudness based on the specific loudness pattern.

12. The method of claim 11, further comprising:

based on one of an excitation pattern, the specific loudness pattern, and the total instantaneous loudness, altering a characteristic of the audio segment to increase the total instantaneous loudness of the audio segment.

13. The method of claim 11, further comprising:

based on one of an excitation pattern, the specific loudness pattern, and the total instantaneous loudness, altering a characteristic of the audio segment to decrease the total instantaneous loudness of the audio segment.

14. The method of claim 1, wherein determining the average intensity pattern function at the each of the first plurality of detector locations, wherein the average intensity pattern function is determined using at least one of the first plurality of frequency components further comprises:

for each of the first plurality of detector locations:

selecting a set of detector locations substantially within one half of an ERB unit on either side of each of the first plurality of detector locations;

determining an intensity for each detector location in the set of detector locations based on a magnitude of each of a plurality of frequency components within one ERB unit of the each detector location; and determining the average intensity pattern function at a corresponding each of the first plurality of detector locations based on an average of the intensity of the detector locations in the set of detector locations.

15. The method of claim 1, wherein the average intensity pattern function is substantially based on one of the following formulas:

$$Y(k) = \frac{1}{11}\sum_{m=-5}^{5} I(k-m),$$

$$\text{for } k = 1, \ldots, D$$

where I represents an intensity at a respective detector location $d_k$, D represents a total number of detector locations d, and k is an index into a set of detector locations d or $$H(z) = \frac{1}{11}\frac{z^5 - z^{-5}}{1 - z^{-1}}$$

wherein H(z) is a Z-transform of the average intensity pattern function.

16. A computer-implemented method for determining an auditory pattern associated with an audio segment, comprising:

receiving, by a processor, a first plurality of frequency components that describe the audio segment in terms of frequency and magnitude, wherein each of the first plurality of frequency components corresponds to one of a plurality of detector locations on an auditory scale;

determining an average intensity pattern function at each of a first plurality of detector locations on the auditory scale, wherein the average intensity pattern function is determined using at least one of the first plurality of frequency components determining a second plurality of frequency components, wherein the second plurality of frequency components is determined based on at least one of the average intensity pattern function and the first plurality of frequency components, wherein locations of the second plurality of frequency components are time-varying;

determining a plurality of tonal bands in the audio segment, wherein each tonal band comprises a particular range of detector locations of the first plurality of detector locations;

for the each of the plurality of tonal bands, selecting a corresponding strongest frequency component from the first plurality of frequency components that corresponds to a location within the particular range of detector locations corresponding to the each of the plurality of tonal bands;

determining a plurality of non-tonal bands in the audio segment;

for each of the plurality of non-tonal bands, dividing the each of the plurality of non-tonal bands into a plurality of sub-bands, and for each of the plurality of sub-bands determining a corresponding combined frequency component that is representative of a combined sum of intensities of the first plurality of frequency components that are in the corresponding sub-band; and determining an excitation pattern based on the corresponding strongest frequency components and the corresponding combined frequency components.

17. A computer program product, comprising a computer-usable medium having a computer-readable program code embodied therein, the computer-readable program code adapted to be executed on a processor to implement a method for determining an excitation pattern associated with an audio segment, the method comprising:

receiving, by the processor, a first plurality of frequency components that describe the audio segment in terms of frequency and magnitude, wherein each of the first plurality of frequency components corresponds to one of a plurality of detector locations on an auditory scale;

determining, an average intensity pattern function at each of a first plurality of detector locations on the auditory scale, wherein the average intensity pattern function is determined using at least one of the first plurality of frequency components;

determining a second plurality of frequency components, wherein the second plurality of frequency components is determined based on at least one of the average intensity pattern function and the first plurality of frequency components, wherein locations of the second plurality of frequency components are time-varying;

determining a detector location subset based on the average intensity pattern function; and determining the excitation pattern based on at least one of the second plurality of frequency components and the detector location subset.

18. The computer program product of claim 17, wherein determining the detector location subset based on the average intensity pattern function comprises determining, based on the average intensity pattern function, a plurality of tonal bands in the audio segment, wherein each tonal band comprises a particular range of detector locations of the first plurality of detector locations;

for each of the plurality of tonal bands, selecting a corresponding strongest frequency component from the first plurality of frequency components that corresponds to a location within the particular range of detector locations corresponding to the each of the plurality of tonal bands;

determining a plurality of non-tonal bands in the audio segment;

for each of the plurality of non-tonal bands, dividing the each of the plurality of non-tonal bands into a plurality of sub-bands, and for each of the plurality of sub-bands determining a corresponding combined frequency component that is representative of a combined sum of intensities of the first plurality of frequency components that are in the corresponding sub-band; and wherein determining the excitation pattern based on the at least one of the second plurality of frequency components and the detector location subset comprises determining the excitation pattern based on the corresponding strongest frequency components and the corresponding combined frequency components.

19. A processing device, comprising:

an input port; and a control system comprising a processor coupled to the input port, the control system adapted to:

receive a first plurality of frequency components that describe an audio segment in terms of frequency and magnitude, wherein each of the first plurality of frequency components corresponds to one of a plurality of detector locations on an auditory scale determine an average intensity pattern function at each of a first plurality of detector locations on the auditory scale, wherein the average intensity pattern function is determined using at least one of the first plurality of frequency components;

determine a second plurality of frequency components, wherein the second plurality of frequency components is determined based on at least one of the average intensity pattern function and the first plurality of frequency components, wherein locations of the second plurality of frequency components are time-varying;

determine a detector location subset based on the average intensity pattern function; and determine an excitation pattern based on at least one of the second plurality of frequency components and the detector location subset.

20. The processing device of claim 19, wherein the control system is adapted to determine the second plurality of frequency components by:

determining, based on the average intensity pattern function, a plurality of tonal bands in the audio segment, wherein each tonal band comprises a particular range of detector locations of the first plurality of detector locations;

for each of the plurality of tonal bands, selecting a corresponding strongest frequency component from the first plurality of frequency components that corresponds to a location within the particular range of detector locations corresponding to the each of the plurality of tonal bands;

determining a plurality of non-tonal bands in the audio segment;

for each of the plurality of non-tonal bands, dividing the each of the plurality of non-tonal bands into a plurality of sub-bands, and for each of the plurality of sub-bands determining a corresponding combined frequency component that is representative of a combined sum of intensities of the first plurality of frequency components that are in the corresponding sub-band; and wherein determining the excitation pattern based on the at least one of the second plurality of frequency components and the detector location subset comprises determining the excitation pattern based on the corresponding strongest frequency components and the corresponding combined frequency components.

21. The processing device of claim 20, wherein the control system is further adapted to:

determine a total instantaneous loudness based on the excitation pattern;

compare the total instantaneous loudness to a loudness threshold; and based on the comparison, alter an audio signal such that the total instantaneous loudness is altered.

22. The processing device of claim 21, wherein the processing device comprises one of a hearing aid, a controller for a cochlear implant, and a signal processing circuit in an audio receiver.

* * * * *